US006286305B1

(12) United States Patent
Poublon et al.

(10) Patent No.: US 6,286,305 B1
(45) Date of Patent: Sep. 11, 2001

(54) MODEL BASED ENRICHMENT FOR EXHAUST TEMPERATURE PROTECTION

(75) Inventors: Mark J Poublon, Shelby Township; Kathryn A Wolfe, Sterling Heights, both of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/511,229

(22) Filed: Feb. 23, 2000

(51) Int. Cl.[7] ..... F01N 3/00

(52) U.S. Cl. ..... 60/285; 60/277; 60/274; 73/118.1

(58) Field of Search ..... 60/274, 277, 300, 60/278, 285; 73/118.1

(56) References Cited

U.S. PATENT DOCUMENTS

| | | | | |
|---|---|---|---|---|
| 5,018,348 | | 5/1991 | Dürschmidt et al. . | |
| 5,414,994 | * | 5/1995 | Cullen et al. | 60/274 |
| 5,606,855 | * | 3/1997 | Tomisawa | 60/274 |
| 5,645,745 | | 7/1997 | Hartwick et al. . | |
| 5,722,236 | * | 3/1998 | Cullen et al. | 60/274 |
| 5,729,971 | * | 3/1998 | Matsuno et al. | 60/277 |
| 5,802,843 | * | 9/1998 | Kurihara et al. | 60/274 |
| 5,802,844 | | 9/1998 | Lee et al. . | |
| 5,847,271 | | 12/1998 | Poublon et al. . | |
| 5,855,113 | * | 1/1999 | Cullen et al. | 60/274 |
| 5,857,163 | * | 1/1999 | Trombley et al. | 701/101 |
| 5,930,993 | * | 8/1999 | Kammann et al. | 60/274 |
| 5,945,597 | | 8/1999 | Poublon et al. . | |
| 5,983,628 | | 11/1999 | Borroni-Bird et al. . | |
| 5,987,885 | | 11/1999 | Kizer et al. . | |
| 6,006,153 | | 12/1999 | Stander et al. . | |
| 6,050,087 | * | 4/2000 | Kurihara et al. | 60/274 |
| 6,092,368 | * | 7/2000 | Ishii et al. | 60/277 |

* cited by examiner

*Primary Examiner*—Thomas Denion
*Assistant Examiner*—Binh Tran
(74) *Attorney, Agent, or Firm*—Mark P. Calcaterra

(57) ABSTRACT

A method for controlling the temperature of a catalyst in a catalytic converter. The method includes the steps of calculating a stabilized catalyst temperature limit, determining a stabilized catalyst temperature without enrichment, comparing the stabilized catalyst temperature limit with the stabilized catalyst temperature without enrichment and enriching a fuel/air ratio to maintain a stabilized catalyst temperature at the stabilized catalyst temperature limit if the stabilized catalyst temperature without enrichment is greater than the stabilized catalyst temperature limit. A vehicle having a controller for controlling the enrichment of an air/fuel ratio to control the temperature of a catalyst in a catalytic converter is also provided.

15 Claims, 2 Drawing Sheets

MODEL BASED ENRICHMENT FOR EXHAUST TEMPERATURE PROTECTION

CROSS-REFERENCE TO RELATED APPLICATIONS

Other features of the present invention are discussed and claimed in commonly assigned copending U.S. application Ser. No. 09/543,123 entitled Catalyst Temperature Model.

BACKGROUND OF THE INVENTION

1. Technical Field

The present invention relates generally to the control of internal combustion engines and more particularly to a control device and a method for controlling the enrichment of a fuel/air ratio supplied to an internal combustion engine to maintain the temperature of a catalyst in a catalytic converter below a predetermined temperature limit.

2. Discussion

Catalytic converters are used to reduce major air pollutants, such as hydrocarbons, carbon monoxide and oxides of nitrogen, contained in the exhaust gas from an internal combustion engine of a motor vehicle. Each converter contains catalysts that produce an exothermic chemical reaction that transforms noxious pollutants into carbon dioxide and water vapor. The catalytic converter is integrated downstream from the vehicle's engine into the vehicle's exhaust system.

The effectiveness of reducing pollutants by a catalytic converter is highly dependent on the temperature and total gas throughput which in turn depends on the operational states and conditions of the internal combustion engine. Over time, catalyst efficiency degrades and thus decreases the capacity of the converter to convert noxious pollutants. Increasingly stringent federal and state motor vehicle emission standards include regulations on the longevity of emission controlling devices such as catalytic converters.

One factor which causes the performance of the catalytic converter to severely deteriorate over time due is the operation of the catalytic converter at high temperatures for prolonged periods of time. Accordingly, it would be desirable to provide a controller and a method for controlling the operation of the vehicle to maintain the temperature of the catalyst in the catalytic converter below a predetermined temperature limit so as to prolong the effective life of the catalytic converter.

SUMMARY OF THE INVENTION

It is one object of the present invention to provide a method which controls the temperature of a catalyst in a catalytic converter below a predetermined temperature limit.

It is a more specific object of the present invention to provide a method for controlling the temperature of a catalyst in a catalytic converter through the enrichment of a fuel/air ratio.

It is another object of the present invention to provide a vehicle having a controller for controlling the enrichment of an air/fuel ratio to control the temperature of a catalyst in a catalytic converter.

In one form, the present invention provides a method for controlling the temperature of a catalyst in a catalytic converter. The method includes the steps of calculating a stabilized catalyst temperature limit, determining a stabilized catalyst temperature without enrichment, comparing the stabilized catalyst temperature limit with the stabilized catalyst temperature without enrichment and enriching a fuel/air ratio to maintain a stabilized catalyst temperature at the stabilized catalyst temperature limit if the stabilized catalyst temperature without enrichment is greater than the stabilized catalyst temperature limit. A vehicle having a controller for controlling the enrichment of an air/fuel ratio to control the temperature of a catalyst in a catalytic converter is also provided.

Additional advantages and features of the present invention will become apparent from the subsequent description and the appended claims, taken in conjunction with the accompanying drawings.

DETAILED DESCRIPTION OF THE PREFERRED EMBODIMENT

Figure 1:
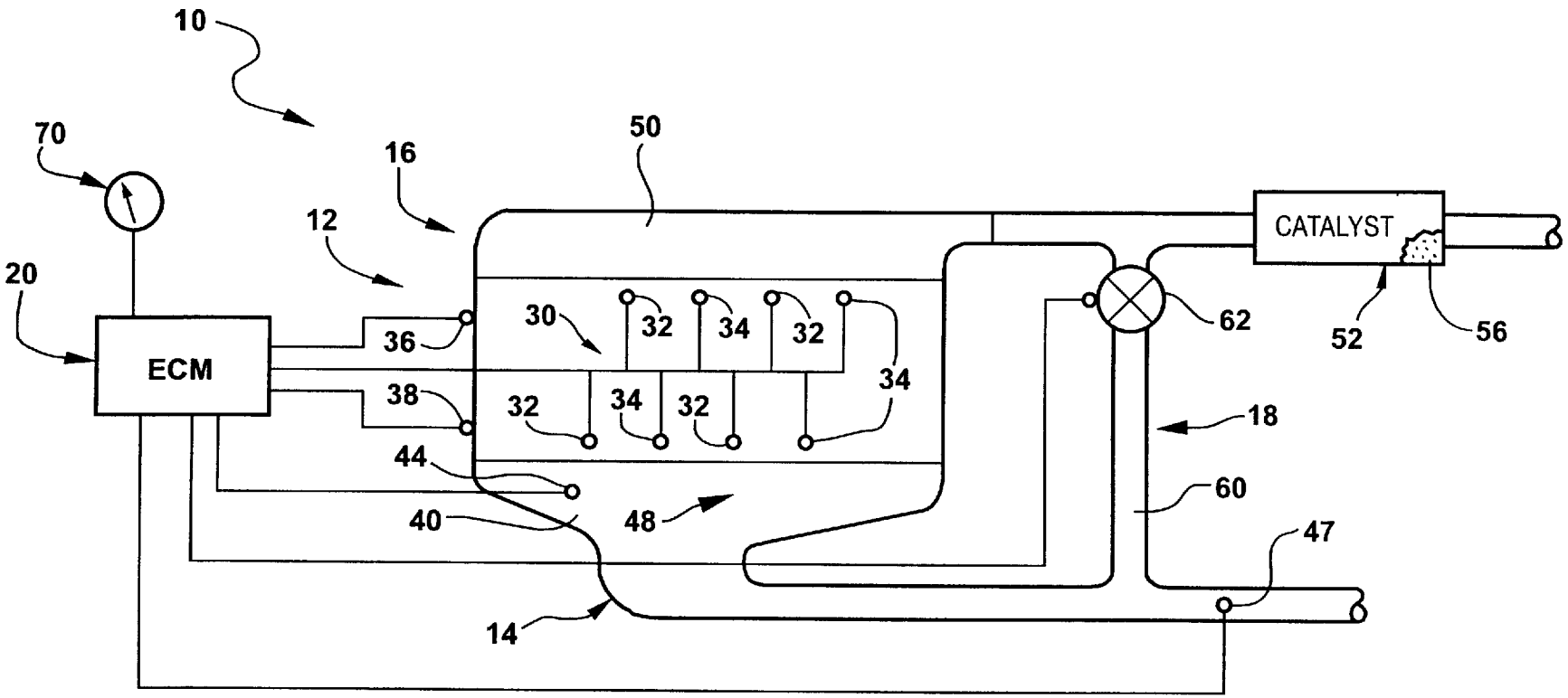
FIG. 1 is a schematic illustration of a portion of a vehicle constructed in accordance with the teachings of the present invention.

With reference to FIG. 1 of the drawings, a vehicle constructed in accordance with the teachings of the present invention is generally indicated by reference numeral 10. Vehicle 10 is shown to include an engine assembly 12, an air intake system 14, an exhaust system 16, an exhaust gas recirculation system 18 and a controller 20. Engine assembly 12 conventionally includes an internal combustion engine 30, a plurality of fuel injectors 32, a plurality of spark plugs 34, a knock sensor 36 and a crankshaft speed sensor 38.

Controller 20 is conventionally coupled to fuel injectors 32 to selectively control the magnitude of a fuel charge delivered to each of the cylinders of engine 30. Controller 20 is also conventionally coupled to spark plugs 34 to permit the spark delivery angle to be varied in a desired manner.

Knock sensor 36 is coupled to engine 30 and is operable for sensing vibrations associated with a knocking cylinder and producing a knock sensor signal in response thereto. Crankshaft speed sensor 38 is operable for sensing the rotational speed of the engine crankshaft (not specifically shown) and producing a speed signal in response thereto. Controller 20 receives knock sensor signal and speed signal.

Air intake system 14 is shown to include an intake manifold 40, a throttle 42, a manifold absolute pressure MAP sensor 44, a throttle position sensor 46 and an ambient air temperature sensor 47. Intake manifold 40 and throttle 42 are conventional in construction and operation and need not be discussed in detail. Briefly, throttle 42 is selectively positionable between a closed position which inhibits the flow of air into intake manifold 40, and an open position. Throttle 42 and the plurality of fuel injectors 32 cooperate to form a fuel/air delivery means 48 for selectively controlling a fuel/air ratio delivered to engine 30.

MAP sensor 44 is operable for sensing the pressure of a gas in the intake manifold 40 and producing a MAP sensor signal in response thereto. Throttle position sensor 46 is operable for sensing the amount by which throttle 42 is opened and producing a throttle position signal in response thereto. Ambient air temperature sensor 47 is operable for sensing the temperature of the air being drawn into air intake system 14 and producing an ambient air temperature signal in response thereto. Controller 20 receives the MAP signal, the throttle position signal and the ambient air temperature signal. Controller 20 is able to calculate the flow rate of air into engine 30 based on the signals from the sensors described above.

Exhaust system 16 includes an exhaust manifold 50 and a catalytic converter 52. Exhaust manifold 50 and catalytic converter 52 are conventional in their construction and operation and need not be discussed in detail. Briefly, exhaust manifold 50 directs exhaust gases into catalytic converter 52 where the exhaust gases contact a catalyst 56. If the temperature of catalyst 56 is above a predetermined light-off temperature, catalyst 56 participates in an exothermic reaction wherein noxious components of the exhaust gases are converted to carbon dioxide and water vapor. Controller 20 is able to calculate the flow rate of exhaust gases discharged from engine 30 since the intake air flow is known.

Exhaust gas recirculation system 18 includes a conduit 60 and a valve assembly 62. Conduit 60 couples valve assembly 62 to exhaust system 16 and air intake system 14. Controller 20 is operable for selectively controlling valve assembly 62 between an open position and a closed position to control an amount of exhaust gas input to air intake system 14. Controller 20 is also coupled to a plurality of vehicle sensors, such as vehicle speed sensor 70, and receives a plurality of sensor signals indicative of a plurality of vehicle dynamics, such as the vehicle speed.

Figure 2:
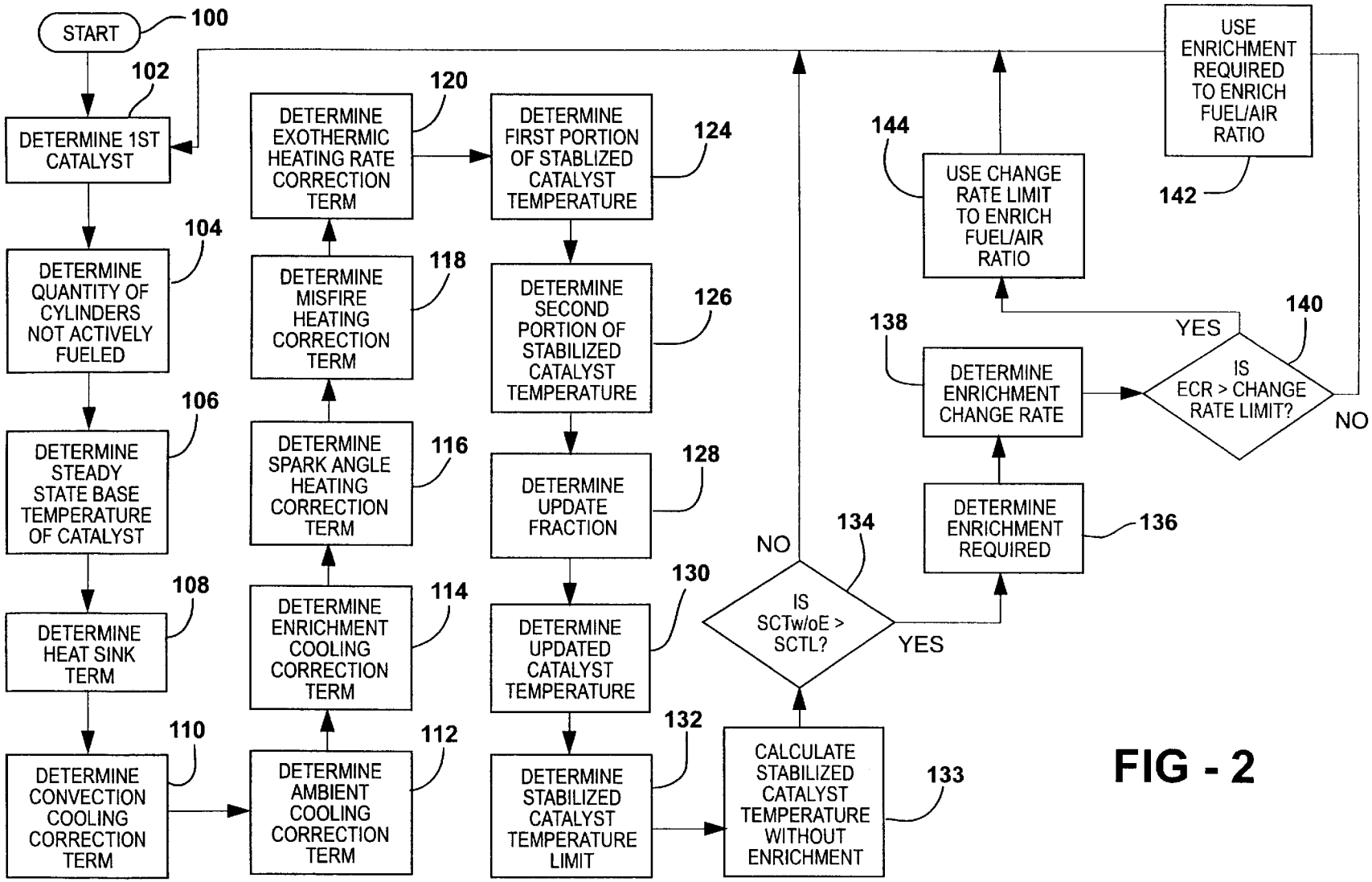
FIG. 2 is a schematic illustration of the method of the present invention in flow chart form.

In FIG. 2, the method of the present invention is illustrated in flowchart form. The method is entered at bubble 100 and proceeds to block 102 where the methodology determines a first catalyst temperature. If the updated catalyst temperature is known from a previous iteration of the methodology and engine assembly 12 has not been turned off, the methodology will set the first catalyst temperature equal to the updated catalyst temperature in block 102.

Otherwise, the methodology will set the first catalyst temperature equal to an initialized startup value which has been calculated from a model that considers the value of last catalyst temperature that had been calculated, the ambient air temperature and the elapsed time since the calculation of the last catalyst temperature. Accordingly, the initialized startup value may be calculated according to the following formula:

$$T(ISUV)=T(LCCT)-\{[T(LCCT)-T(AMB)]\times \mathrm{CDF}\}$$

where:

T(ISUV)=the initialized startup value;

T(LCCT)=the last calculated catalyst temperature;

T(AMB)=the ambient air temperature; and

CDF=a cool down fraction which approximates how completely the catalyst 56 has cooled down based upon the elapsed time since the calculation of the last catalyst temperature.

The methodology next proceeds to block 104 where the methodology determines the quantity of cylinders which are not being actively fueled, as when engine 30 is being used as an air pump to decelerate the vehicle or to provide greater fuel economy. The methodology then proceeds to block 106.

In block 106 the methodology next determines a steady state base temperature of catalyst 56. The steady state base temperature is related to both the amount of heat which is directed to catalyst 56 and the amount of heat generated by catalyst 56 at the present condition under which vehicle 10 is being operated. In the particular embodiment disclosed data for the steady state base temperature is provided in tabular form and is based on the manifold absolute pressure and the engine rotational speed.

The methodology next proceeds to block 108 where a heat-sink term is calculated. The heat-sink term reflects the loss of heat from the exhaust gas to the exhaust system 16 after vehicle 10 is started. The heat sink term is initialized at the start-up of the vehicle 10 and is based on the amount of time since the engine assembly 12 had last been operated (i.e., the length of time the engine assembly 12 had been off). The heat sink term decays to a value of zero at a rate based on the flow rate of exhaust gases discharged from engine 30. The methodology next proceeds to block 110.

In block 110 the methodology calculates a convection cooling correction term based on the speed of vehicle 10 as sensed by vehicle speed sensor 70. The convection cooling correction term takes into consideration the fact that heat will be released from the catalytic converter 52 to the environment through convection cooling when vehicle 10 is being operated and that the amount of heat that is released will be approximately proportional to the speed of vehicle. The methodology next proceeds to block 112.

In block 112 the methodology determines the ambient air temperature as sensed by ambient air temperature sensor 47. The methodology then calculates the difference between a reference temperature and the ambient temperature and uses this difference to calculate an ambient cooling correction term. The ambient cooling correction term takes into consideration the fact that the data for the steady state base temperature is based on data taken at a predetermined ambient temperature such as 70° F. Accordingly, the ambient cooling correction term compensates for the variances in the convection cooling correction term that result when the ambient temperature varies from the predetermined ambient temperature at which the data for the steady state base temperature was taken. In the particular embodiment illustrated, the ambient cooling correction term is determined by multiplying the difference between a reference temperature and the ambient temperature by a predetermined ambient correction gain.

The methodology next proceeds to block 114 where the methodology determines an actual fuel/air ratio, calculates the difference between a stoichiometric fuel/air ratio and the actual fuel/air ratio and uses the difference between the stoichiometric fuel/air ratio and the actual fuel/air ratio to calculate an enrichment cooling correction term. The enrichment cooling correction term takes into consideration the heat that is absorbed by unburned fuel that exits the engine 30. In the particular embodiment illustrated, the enrichment cooling correction term is determined by multiplying the absolute value of the difference between the stoichiometric fuel/air ratio and the actual fuel/air ratio by a predetermined fuel/air correction gain.

The methodology then proceeds to block 116 where the methodology calculates a spark angle heating rate correction term. The methodology initially determines a theoretical spark delivery angle that provides a maximum brake torque. The methodology next determines an actual spark delivery angle which may be the most recent spark delivery angle used or an average spark delivery angle as applied to several of the spark plugs 34. The methodology then calculates a difference between the theoretical spark delivery angle and the actual spark delivery angle and uses this difference to calculate a spark angle heating rate correction term. The spark angle heating rate correction term takes into account that as the actual spark delivery angle moves away from the theoretical spark delivery angle for maximum brake torque, less energy from the combustion of a fuel charge is being used in the engine 30 for work (i.e., to push the pistons and rotate the crankshaft) and more energy is being used for the production of heat. In the particular embodiment illustrated, the spark angle heating rate correction term is determined by multiplying the difference between the theoretical spark delivery angle and the actual spark delivery angle by a predetermined spark correction gain. The methodology next proceeds to block 118.

In block 118 the methodology calculates a misfire heating correction term. The methodology initially determines the rate at which the engine 30 is misfiring and uses this rate to calculate the misfire heating correction term. Accordingly, the misfire heating correction term takes into account the absence of combustion in a cylinder that is misfiring and the associated increase in the amount of chemical energy rejected by the engine 30 in the exhaust gases. In the particular embodiment illustrated, the misfire heating correction term is determined by multiplying the rate of misfire by a predetermined misfire correction gain.

The methodology next proceeds to block 120 where the methodology determines if an exothermic heating rate correction term is to be excluded. The exothermic heating rate correction term compensates for the quantity of heat produced by the exothermal reaction within the catalytic converter 52; the exothermal reaction, however, will only take place if the temperature of catalyst 56 is over a predetermined catalyst light-off temperature. Accordingly, the methodology first determines if the first catalyst temperature (as determined at block 102) exceeds a predetermined catalyst light-off temperature. If the first catalyst temperature exceeds the predetermined catalyst light-off temperature, the exothermic heating rate correction term is set to a first predetermined value, such as zero. If the first catalyst temperature does not exceed the predetermined catalyst light-off temperature, the exothermic heating rate correction term is set to a second predetermined value. The methodology next proceeds to block 124.

The methodology next proceeds to block 124 where a first portion of the stabilized catalyst temperature is calculated. The stabilized catalyst temperature is the temperature that the catalyst would stabilize at if the present operating conditions were held constant for a sufficient amount of time. Accordingly, the stabilized catalyst temperature is not necessarily equal to the temperature of the catalyst. The methodology initially sums the steady state base temperature with the heat-sink term, the convection cooling correction term, the ambient cooling correction term, the enrichment cooling correction term, the spark angle heating rate correction term, the misfire heating correction term and the exothermic heating rate correction term. This sum is then multiplied by the fraction of cylinders which are being actively fueled. The fraction of cylinders which are being actively fueled is equal to the quantity of 1−[(the quantity of cylinders not being actively fueled)/(the total quantity of cylinders)].

The methodology next proceeds to block 126 where a second portion of the stabilized catalyst temperature is calculated. The second portion of the stabilized catalyst temperature is based on the fraction of cylinders which are not being actively fueled. The fraction of cylinders which are not being actively fueled is equal to the quantity of cylinders not being actively fueled divided by the total quantity of cylinders. This fraction is multiplied by the temperature of the air after it is pumped through the engine 30. The methodology then proceeds to block 128.

In block 128 the methodology determines an update fraction. The update fraction controls the rate of change of the catalyst temperature from the present value to the stabilized catalyst temperature. In the particular embodiment disclosed, the update fraction is based on the flow rate of exhaust gases discharged from engine 30 and the throttle state (i.e., whether the throttle is open or closed).

In block 130, the methodology calculates an updated catalyst temperature. The updated catalyst temperature is equal to the quantity of {[(the first portion of the stabilized catalyst temperature)+(the second portion of the second stabilized catalyst temperature)]×(update fraction)}+{(the first catalyst temperature)×[1−(the update fraction)]}.

The methodology next proceeds to block 132 to determine the stabilized catalyst temperature limit. The stabilized catalyst temperature limit is based on a predetermined catalyst temperature limit beyond which catalyst 56 should not be heated, such as 900° C. (1650° F.). The stabilized catalyst temperature limit is equal to the quantity of {(the predetermined temperature limit)−[(the first catalyst temperature)×(1−(the update fraction))]}/(the update fraction). The stabilized catalyst temperature limit represents the value of the stabilized catalyst temperature which will cause the stabilized catalyst temperature limit to equal the catalyst temperature limit.

The methodology next proceeds to block 133 where the methodology determines the effect on the stabilized catalyst temperature if no enrichment of the fuel/air ratio is made. The stabilized catalyst temperature without enrichment is equal to the stabilized catalyst temperature where the enrichment cooling correction term is equal to zero (as if the actual fuel/air ratio is equal to the stoichiometric fuel/air ratio).

The methodology next proceeds to decision block 134 where the methodology compares the stabilized catalyst temperature without enrichment to the stabilized catalyst temperature limit. If the stabilized catalyst temperature without enrichment does not exceed the stabilized catalyst temperature limit, no enrichment is required to maintain the temperature of catalyst 56 below the predetermined temperature limit and the methodology returns to block 102.

If the stabilized catalyst temperature without enrichment exceeds the stabilized catalyst temperature limit in decision block 134, enrichment is required to maintain the temperature of catalyst 56 at the predetermined temperature limit. The methodology then proceeds to block 136 where the methodology determines the magnitude of the required enrichment. In block 136, the magnitude of the required enrichment is equal to [(the stabilized catalyst temperature without enrichment)−(the stabilized catalyst temperature limit)]/(the predetermined fuel/air correction gain). The predetermined fuel/air correction gain was used previously in block 114.

The methodology next proceeds to block 138 where an enrichment change rate is calculated. The methodology then proceeds to decision block 140 where the enrichment change rate is compared to a predetermined change rate limit. If the enrichment change rate does not exceed the change rate limit, the methodology proceeds to block 142 where the magnitude of the required enrichment calculated in block 136 is used to enrich the fuel/air ratio (i.e., the magnitude of the enrichment made to the fuel/air ratio is equal to the required enrichment calculated in block 136). The methodology then returns to block 102.

If the enrichment change rate is greater than the change rate limit in decision block 140, the methodology proceeds to block 144 where the change rate limit is used to enrich the fuel/air ratio (i.e., the magnitude of the enrichment made to the fuel/air ratio is equal to the change rate limit). The methodology then returns to block 102.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A method for controlling a temperature of a catalyst in a catalytic converter, the method comprising the steps of:

calculating a stabilized catalyst temperature limit;

determining a stabilized catalyst temperature without enrichment;

comparing the stabilized catalyst temperature limit with the stabilized catalyst temperature without enrichment; and modifying a fuel/air ratio to maintain a stabilized catalyst temperature at the stabilized catalyst temperature limit if the stabilized catalyst temperature without enrichment is greater than the stabilized catalyst temperature limit.

2. The method of claim 1, wherein the step of modifying a fuel/air ratio includes the steps of:

providing a fuel/air correction gain; and calculating a fuel/air change amount by which to enrich the fuel/air ratio based on the stabilized catalyst temperature without enrichment, the stabilized catalyst temperature limit and the fuel/air correction gain.

3. The method of claim 2, wherein the step of calculating the fuel/air change amount includes the steps of:

calculating a difference between the stabilized catalyst temperature without enrichment and the stabilized catalyst temperature limit; and dividing the difference by the fuel/air correction gain.

4. The method of claim 2, further comprising the steps of:

calculating an enrichment change rate based on the fuel/air change amount;

comparing the enrichment change rate to a predetermined change rate limit; and if the enrichment change rate is less than the predetermined change rate limit, modifying the fuel/air ratio by the enrichment change amount.

5. The method of claim 4, further comprising the step of modifying the fuel/air ratio by the change rate limit if the enrichment change rate is not less than the change rate limit.

6. The method of claim 1, wherein the step of calculating a stabilized catalyst temperature limit includes the steps of:

determining a first catalyst temperature;

determining an update fraction;

providing a predetermined catalyst temperature limit; and calculating the stabilized catalyst temperature limit based on the first catalyst temperature, the update fraction and the catalyst temperature limit.

7. The method of claim 6, wherein the step of calculating the stabilized catalyst temperature limit includes the steps of:

calculating a first intermediate term by subtracting the update fraction from a quantity of one (1);

calculating a second intermediate term by multiplying the first intermediate term by the first catalyst temperature;

calculating a third intermediate term by subtracting the second intermediate term from the temperature limit; and calculating the stabilized catalyst temperature limit by dividing the third intermediate term by the update fraction.

8. A vehicle comprising:

an internal combustion engine;

an exhaust system coupled to the internal combustion engine and receiving a supply of exhaust gas discharged therefrom, the exhaust system including a catalytic converter having a catalyst;

fuel/air delivery means for controlling the delivery of fuel and air to the engine at a selectively controllable ratio;

a plurality of first sensors sensing various vehicle dynamics and generating a plurality of first sensor signals in response thereto;

a plurality of second sensors sensing various engine dynamics and generating a plurality of second sensor signals in response thereto;

a plurality of third sensors sensing various characteristics of air input to the engine and exhaust gas discharged from the engine and generating a plurality of third sensor signals in response thereto; and a controller coupled to the fuel/air delivery means and the plurality of first, second and third sensors, the controller receiving the plurality of first, second and third sensor signals and calculating a stabilized catalyst temperature limit and a stabilized catalyst temperature without enrichment, the controller comparing the stabilized catalyst temperature limit with the stabilized catalyst temperature without enrichment and modifying the fuel/air ratio to maintain a stabilized catalyst temperature at the stabilized catalyst temperature limit if the stabilized catalyst temperature without enrichment is greater than the stabilized catalyst temperature limit.

9. The vehicle of claim 8, wherein the controller calculates the fuel/air change amount by which to enrich the fuel/air ratio by calculating a difference between the stabilized catalyst temperature without enrichment and the stabilized catalyst temperature limit and dividing the difference by a fuel/air correction gain.

10. The vehicle of claim 8, wherein the controller limits a rate with which the fuel/air ratio is enriched to an amount which does not exceed a predetermined change rate limit.

11. A method for controlling a temperature of a catalyst in a catalytic converter, the method comprising the steps of:

determining a first catalyst temperature;

determining an update fraction;

providing a predetermined catalyst temperature limit;

calculating the stabilized catalyst temperature limit based on the first catalyst temperature, the update fraction and the catalyst temperature limit;

determining a stabilized catalyst temperature without enrichment;

comparing the stabilized catalyst temperature limit with the stabilized catalyst temperature without enrichment;

providing a fuel/air correction gain;

calculating a fuel/air change amount by which to enrich the fuel/air ratio based on the stabilized catalyst temperature without enrichment, the stabilized catalyst temperature limit and the fuel/air correction gain; and modifying a fuel/air ratio to maintain a stabilized catalyst temperature at the stabilized catalyst temperature limit if the stabilized catalyst temperature without enrichment is greater than the stabilized catalyst temperature limit.

12. The method of claim 11, wherein the step of calculating an fuel/air change amount includes the steps of:

calculating a difference between the stabilized catalyst temperature without enrichment and the stabilized catalyst temperature limit; and dividing the difference by the fuel/air correction gain.

13. The method of claim 11, further comprising the steps of:

calculating an enrichment change rate based on the fuel/air change amount by which to enrich the fuel/air ratio;

comparing the enrichment change rate to a predetermined change rate limit; and modifying the fuel/air ratio by the fuel/air change amount if the enrichment change rate is less than the change rate limit.

14. The method of claim 13, further comprising the step of modifing the fuel/air ratio by the change rate limit if the enrichment change rate in not less than the change rate limit.

15. The method of claim 11, wherein the step of calculating the stabilized catalyst temperature limit includes the steps of:

calculating a first intermediate term by subtracting the update fraction from a quantity of one (1);

calculating a second intermediate term by multiplying the first intermediate term by the first catalyst temperature;

calculating a third intermediate term by subtracting the second intermediate term from the temperature limit; and calculating the stabilized catalyst temperature limit by dividing the third intermediate term by the update fraction.

* * * * *